United States Patent [19]

Jeschke et al.

[11] 4,179,046

[45] Dec. 18, 1979

[54] REFRACTORY PLATE FOR SLIDE CLOSURES OF METALLURGICAL VESSELS

[75] Inventors: Peter Jeschke, Walluf; Günter Gelsdorf, Wiesbaden-Nordenstadt, both of Fed. Rep. of Germany

[73] Assignee: Didier-Werke A.G., Wiesbaden, Fed. Rep. of Germany

[21] Appl. No.: 893,690

[22] Filed: Apr. 5, 1978

[30] Foreign Application Priority Data

Apr. 29, 1977 [DE] Fed. Rep. of Germany ..... 2719105

[51] Int. Cl.[2] ..... B22D 37/00

[52] U.S. Cl. ..... 222/600; 222/603

[58] Field of Search ..... 164/337, 437; 251/326, 251/325; 222/504, 512, 600, 598, 561, 603

[56] References Cited

U.S. PATENT DOCUMENTS 3,831,825 8/1974 Kutzer et al. ..... 222/600

FOREIGN PATENT DOCUMENTS 2012770 3/1970 France ..... 222/600

486865 1/1976 U.S.S.R. ..... 222/600

*Primary Examiner*—David A. Scherbel

*Attorney, Agent, or Firm*—Wenderoth, Lind & Ponack

[57] ABSTRACT

A refractory plate for use in slide closures for metallurgical vessels includes a basic plate element adapted to face a liquid metal melt. The basic plate element is formed of a moldable refractory concrete material including 70 to 95% by weight of alumina and 5 to 30% by weight of a cement containing approximately 80% by weight alumina. Alternatively, the 70 to 95% by weight of alumina may be replaced by an alumina-containing raw material containing more than 70% by weight of alumina, for example at least one raw material selected from the group consisting of sintered bauxite, synthetic mullite, corundum, and grinding disk fragments. The basic plate element has embedded therein a ceramic oxide insert having a cold bending strength higher than 300 kp/cm$^2$, a hot bending strength at 1500° C. higher than 40 kp/cm$^2$, a cold compressive strength higher than 2000 kp/cm$^2$, and a permeability to gas lower than 1.0 nanoperm. The basic plate element and the insert have extending therethrough a throughflow opening. The width of the insert, in a direction transverse to the direction of movement of the refractory plate, is from 1.3 to 3.5 times the diameter of the throughflow opening.

15 Claims, 4 Drawing Figures

REFRACTORY PLATE FOR SLIDE CLOSURES OF METALLURGICAL VESSELS

BACKGROUND OF THE INVENTION

The present invention is directed to refractory plates of the type having extending therethrough at least one throughflow opening. More particularly, the present invention is directed to such refractory plates for use in slide closures for metallurgical vessels. As employed herein, the term "slide plate" refers not only to plates which move rectilinearly, but also to plates which are used in rotary closures and which undergo a rotary movement.

Such slide plates are employed in various metallurgical industries as a valve-type arrangement for allowing a liquid metal melt to be discharged from a metallurgical vessel, or alternatively to close off such discharge. Such slide plates are generally manufactured at the present time of a mullite-corundum material, generally including more than 80% by weight of alumina and ceramically bound at high temperatures. Additionally, it is known to manufacture such slide plates by the use of ceramically bound magnesite. Even further, it is known to form slide plates of a refractory concrete material which is hydraulically bound by the use of a cement having a high alumina content.

Additionally, slide plates formed of combinations of different materials are known. For example, in German DT-OS No. 1,935,424, there is disclosed a slide closure having a slide plate which is embedded in a ceramic support element which has thermal insulation properties. Also, German Pat. No. 1,937,742 discloses a slide plate formed of two materials, specifically highly heat resistant, hard metallic materials or composite metallic materials of molybdenum and zirconium oxide. In this German patent there is provided an insert of hard material which contacts the liquid metal melt. Such insert should be of a hard material which has a high thermal conductivity which results in warming of the sealing surface, to thereby prevent freezing of the melt when the slide is closed. In such prior art arrangement, a slide plate is formed of a high alumina-containing ceramically bound material. The slide plate has a recess into which is adhered by means of an elastic cement the insert of hard material.

According to the results of recently conducted tests and measurements, refractory plates made of a single material are subject to a destruction mechanism as a result of shock-type increases in temperature in the area of the throughflow opening during the liquid metal melt pouring operation. This results in considerable tangential tensile stresses occurring in the material of the plate at positions a few centimeters away from the throughflow opening. Thus, the plate cracks in such areas in directions radially of the throughflow opening, and such cracking can be more or less visually observed. Thereafter, when the slide closure, including the refractory plate, is moved to a closed position, the closing surface portion of the slide plate, which cuts off the jet of liquid metal melt, is suddenly heated from a previous relatively lower temperature (i.e., on the order of approximately 500° to 800° C.) to a much higher temperature, i.e., on the order of 1500° C. This rapid temperature change leads to relatively high tensile stresses occurring in the material of the plate in an area up to a few millimeters below the surface of the plate which is contacted by the melt. This stressing of such surface will eventually result in elliptical or cup-shaped chipping or peeling of the surface of the plate which is contacted by the melt during the closed position of the slide closure.

Additionally, when the closure is repeatedly opened and closed, or placed in a jet throttling position, an erosion-type washing out occurs along the edge of the throughflow opening. Additionally, particles of steel and slag will gain access to the area between the plates of the slide closure. Such particles will thereafter solidify and will result in erosion of the plate surfaces that slide against each other. Even further, the plates will be subjected to the corrosion action of FeO, acid and slag originating within the melt.

From the above discussion of the recently recognized stressing phenomenon to which the refractory slide plate is subjected, it will be apparent that it would be extremely desirable if the refractory slide plate has the following properties:

(1) A high resistance or durability to cracking;

(2) a high resistance or durability to peeling or chipping;

(3) a high resistance to erosion; and (4) a high resistance or stability against chemical corrosion.

At the present time, no single material is capable of satisfactorily meeting all of the above four requirements in an economically satisfactory manner. Standard refractory slide plate materials, such as alumina and magnesite, are in some respects satisfactory. However, such customary materials are only moderate to poor with regard to other of the above requirements. For example, magnesite plates have a poor resistance to cracking, while mullite-corundum plates have only a moderate crack resistance and a moderate resistance to chemical corrosion.

With regard to the above noted German Pat. No. 1,937,742, which discloses a plate formed of two materials, the insert discloses in such German patent is a powder metallurgical insert which does not meet all of the above four requirements. Particularly, the powder metallurgical insert of such German patent has only a moderate density and thus offers a poor resistance to erosion. Therefore, and in view of the fact that powder metallurgical inserts are expensive to manufacture, such known slide plate is relatively costly when compared with its expected service life. This is particularly true when considering the fact that the high alumina-containing material, within which the insert is embedded, is likewise a costly material to manufacture. Further, the purpose of using the powder metallurgical insert of such German patent is to produce a controlled transfer of heat from the throughflow opening to that portion of the slide which is subjected to freezing of the melt when the slide is in the closed position.

SUMMARY OF THE INVENTION

With the above discussion in mind, it is the primary object of the present invention to provide an improved refractory plate which overcomes the disadvantages of the prior art and which meets all of the above four noted desirable properties.

It is a further object of the present invention to provide such an improved refractory plate which is simple to manufacture and which has an improved service life.

These objects are achieved in accordance with the present invention by providing a refractory plate for use in slide closures for metallurgical vessels, wherein the slide plate includes a basic plate element having embedded therein a ceramic oxide insert, such that the insert faces and contacts the melt.

The basic plate element may be formed to have any refractory slide plate configuration which is conventional and known in the art. The basic plate element is formed of a moldable refractory concrete material which is molded around the insert. That is, the already formed insert can be easily embedded in the moldable material which is used to form the basic plate element.

Preferably, the moldable refractory concrete material of the basic plate element comprises 70 to 95% by weight of alumina and 5 to 30% by weight of a cement containing approximately 80% by weight alumina. The 70 to 95% by weight alumina is preferably tabular alumina having a grain size of up to 6.0 mm. Alternatively, the 70 to 95% by weight of tabular alumina may be replaced by 70 to 95% by weight of an alumina-containing raw material containing more than 70% by weight of alumina. Preferably, such alumina-containing raw material is at least one material selected from the group consisting of sintered bauxite, synthetic mullite, corundum, and grinding disk fragments.

The cement which contains approximately 80% by weight of alumina may be any conventional such ceramic cement which is known in the art.

The ceramic oxide insert has a cold bending strength higher than 300 kp/cm$^2$, a hot bending strength at 1500° C. higher than 40 kp/cm$^2$, a cold compressive strength higher than 2000 kp/cm$^2$, and a porosity or permeability to gas lower than 1.0 nanoperm.

The ceramic oxide insert is formed of a material having a melting point higher than 1950° C., and preferably the ceramic oxide insert is formed of at least 99% by weight of at least one oxide material having a melting point higher than 1950° C. Examples of such ceramic oxide materials are MgO, $Cr_2O_3$, $Al_2O_3$ and $ZrO_2$. Preferably the ceramic oxide insert is formed of at least one material selected from the group consisting of such oxides. It has particularly been found that combinations of $Al_2O_3$ and $ZrO_2$ and combinations of $ZrO_2$ and $Cr_2O_3$ are particularly suitable mixtures for the material of the ceramic oxide insert. When the dominant material of the ceramic oxide insert is $ZrO_2$, then CaO may be added as a stabilizing agent. The sum of all impurities or all oxides the melting point of which is below 1950° C., should not exceed 1% by weight of the material forming the ceramic oxide insert. The above specifically noted oxides, or similar oxides having melting points above 1950° C., in the form of compounds or mixed crystals may be formed into fired ceramic fragments.

The basic plate element and the ceramic oxide insert have extending therethrough a throughflow opening. The insert has a width, taken in a direction transverse to the direction of movement of the refractory plate when used in a slide closure, of from 1.3 to 3.5 times the diameter of the throughflow opening, as a function of the bending strength, the modulus of elasticity, and the coefficient of thermal expansion of the insert.

By forming the refractory plate of the above discussed basic plate element formed of a moldable refractory concrete material and a ceramic oxide insert having the above discussed properties, it is possible to substantially simplify the manufacture of the refractory plate. That is, the manufacture of the ceramic oxide insert, apart from employing higher than normal pressures of approximately 1000 kp/cm$^2$ and higher than normal firing or sintering temperatures of approximately 1750° C., is substantially no different from the manufacture of other conventionally known high quality refractory elements. Additionally, the already made insert can be easily embedded in the mixture of moldable refractory concrete material when the basic plate element is being molded. After the completion of the molding operation, the composite refractory plate, including the insert and the basic plate element, can be subjected to a final drying and/or thermal treatment. Thus, the manufacture of the novel refractory plate of the present invention is relatively simple and uncomplicated.

In addition to the above discussed advantage of relatively simple manufacture, the component refractory plate of the present invention has an optimal combination of the above noted four desirable properties, i.e. (1) high resistance or durability to cracking, (2) high resistance or durability to peeling or chipping, (3) high resistance to erosion, and (4) high resistance or stability to chemical corrosion. For a given oxide ceramic material employed for a given insert, it is possible to determine an optimal width of the insert at which the insert will withstand operation of the slide plate without being cracked. Such determination of the width dimension of the insert is based on the diameter of the throughflow opening through the insert as a function of the bending strength, the modulus of elasticity, and the coefficient of thermal expansion of the insert. Therefore, the tangential tensile stresses which occur in the insert during a melt pouring operation can be maintained below a designed tensile or bending strength. Thus, in addition to the importance of the characteristics of the material of the insert, the neutralizing of tensile stresses occurring in the insert during a melt pouring operation are also substantially dependent upon the width of the insert. The required high bending or tensile strength further increases the resistance of the insert to chipping or peeling. The provision of the required high cold compressive strength and the high degree of impermeability to gas results in the required high resistance to erosion. The required high resistance to corrosion, particularly chemical corrosion caused by the action of FeO and slag, is achieved by the high purity of the ceramic oxide materials employed in the insert and also due to the high degree of impermeability of the insert to gas.

In accordance with a further feature of the present invention, and to avoid stresses which may occur during the drying and thermal treatment of the refractory plate, a layer of elastic material may circumferentially surround the outer periphery of the insert and separate the insert outer periphery from the basic plate element. Thus, during possible differential expansion and shrinkage of the insert and basic plate element during the drying and thermal treatment of the composite refractory plate, any resulting stresses are prevented from damaging the composite elements of the refractory plate. It is believed to be apparent to those skilled in the art that such elastic layer may be formed of any material which is capable of avoiding such potential stresses during formation of the composite refractory plate, and which will also function as a portion of the refractory plate during use thereof and after the production thereof. Preferably, the material of the elastic layer may be the same material employed to form the basic plate element, but made flexible to a degree sufficient to neutralize the above discussed expansion or shrinkage. Such flexibility may be achieved by selecting a suitable grain size of the moldable refractory concrete material used to form the elastic layer, for example an alumina grain size of up to 0.5 mm, and by adding to such moldable refractory concrete material approximately 3% by weight of a powdered paper or cellulose material. Such powdered paper or cellulose material will burn out during the drying or thermal treatment of the refractory plate. Alternatively, the elastic layer could be formed of a synthetic resin material including a filler material such as Styrofoam. It is believed that it will be apparent to those skilled in the art that other materials could be employed to form the elastic layer so as to neutralize thermal expansion or shrinkage during the drying or thermal treatment of the refractory plate.

In accordance with a further feature of the present invention, the refractory plate may be a composite three-plate member, wherein the basic plate element has on opposite major surfaces thereof one of the ceramic oxide inserts. Such an arrangement would be of particular advantage wherein the refractory plate is used in a special slide closure of the type wherein the refractory plate is the center plate which slides against opposite plates.

In accordance with an even further feature of the present invention, and wherein the slide plate is equipped with means for supplying a gas to the surface of the plate which faces the melt when the slide closure is in its closed position, to thereby prevent freezing of the melt, the insert may have extending therethrough gas passages communicating with a gas feed extending through the basic plate element.

BRIEF DESCRIPTION OF THE DRAWINGS

The above and other objects, features and advantages of the present invention will be further apparent from the following detailed description of preferred embodiments thereof, with reference to the accompanying drawings, wherein.

DETAILED DESCRIPTION OF THE INVENTION

Figure 1:
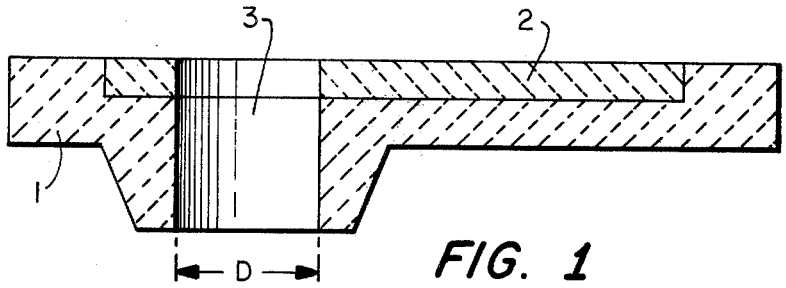
FIG. 1 is a longitudinal cross-section through one embodiment of the improved refractory plate of the present invention.
Figure 2:
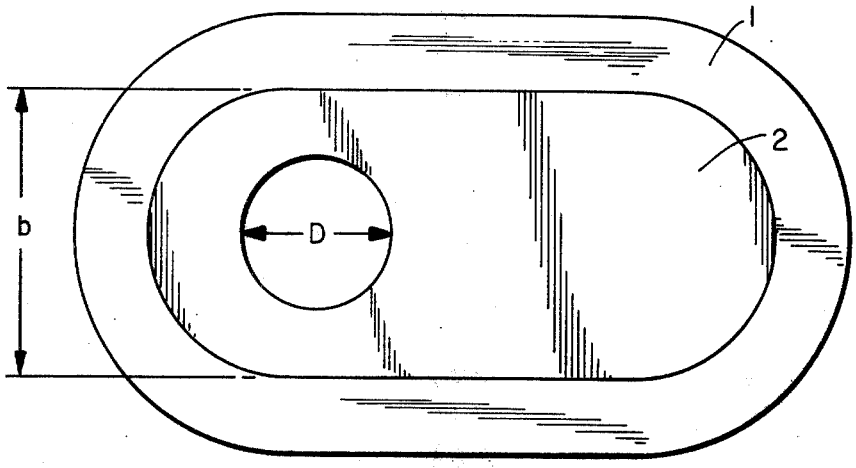
FIG. 2 is a plan view of the refractory plate of FIG. 1.

With reference now to FIGS. 1 and 2 of the drawings, a first embodiment of a composite refractory plate according to the present invention will be described.

The composite refractory plate includes a basic plate element 1 having embedded therein a ceramic oxide insert 2. The basic plate element and the insert have extending therethrough a throughflow opening 3. As will be understood by those skilled in the art, the composite refractory plate of FIGS. 1 and 2 is used in a slide closure for a metallurgical vessel in a manner such that the refractory plate slides between a first position whereat throughflow opening 3 aligns with a spout opening in the vessel, and a second closed position whereat the spout opening in the metallurgical vessel is faced by the upper surface of insert 2 as shown in FIGS. 1 and 2.

The ceramic oxide insert 2 is formed of ceramic oxide materials having a melting point higher than 1950° C., and preferably the ceramic oxide insert is formed of at least 99% by weight of at least one ceramic oxide material having a melting point higher than 1950° C. Examples of such ceramic oxide materials are MgO, $Cr_2O_3$, $Al_2O_3$ and $ZrO_2$, and preferably the ceramic oxide insert is formed of at least one material selected from the group consisting of such oxides. The sum of all impurities or all oxides the melting point of which is below 1950° C. should not exceed 1% by weight of the material forming the ceramic oxide insert. The ceramic oxide insert must have a cold bending strength higher than 300 kp/cm$^2$, a hot bending strength at 1500° C. higher than 40 kp/cm$^2$, a cold compressive strength higher than 2000 kp/cm$^2$, and a permeability to gas lower than 1.0 nanoperm.

The insert 2, formed to have a desired configuration and formed from the above noted ceramic oxide materials, or other ceramic oxide materials having a melting point higher than 1950° C., is then pressed at a pressure of approximately 1000 kp/cm$^2$ and is fired at a temperature of approximately 1750° C.

The basic plate element 1 is molded into a desired and conventional configuration by the use of a moldable refractory concrete material. Preferably, such moldable refractory concrete material comprises 70 to 95% by weight of tabular alumina and 5 to 30% by weight of a cement containing approximately 80% by weight alumina. The tabular alumina preferably has a grain size of up to 6.0 mm. Alternatively, the tabular alumina may be replaced by 70 to 95% by weight of an alumina-containing raw material containing more than 70% by weight of alumina. Such alumina-containing raw material may include at least one material selected from the group consisting of sintered bauxite, synthetic mullite, corundum, and grinding disk fragments. Any known ceramic cement containing approximately 80% by weight of alumina may be employed.

The above described moldable refractory concrete is mixed and placed in a suitable mold, and the already formed ceramic oxide insert 2 is positioned therein. Accordingly, during the molding operation of the basic plate element, the insert 2 will be embedded in the basic plate element. After the completion of the molding operation, the composite refractory plate, including the insert and basic plate element, can be subjected to a final drying and/or thermal treatment.

The width b of insert 2, taken in a direction transverse to the direction of movement of the refractory plate when used in a slide closure, is from 1.3 to 3.5 times the diameter D of the throughflow opening 3. Such dimensioning of the width b of the insert is determined as a function of the bending strength, the modulus of elasticity, and the coefficient of thermal expansion of the insert 2.

The procedure for manufacturing the composite refractory plate of the present invention will be apparent from the following description of two examples thereof.

The starting materials of the ceramic oxide inserts were as follows:

| | % by weight | |
|---|---|---|
| Material | Example 1 | Example 2 |
| $Al_2O_3$ | 50 | — |
| $ZrO_2$ | 50 | 80 |

-continued

| Material | % by weight Example 1 | Example 2 |
|---|---|---|
| $Cr_2O_3$ | — | 20 |

Ceramic oxide inserts were formed into a desired configuration employing the above mixtures, and the inserts were then pressed at a pressure of approximately 1000 kp/cm$^2$ and were fired at a temperature of approximately 1750° C.

The resulting inserts had the following properties:

| | Example 1 | Example 2 |
|---|---|---|
| Total porosity (%) | 9.1 | 5.2 |
| Open porosity (%) | 5.2 | 3.0 |
| Cold compressive strength (kp/cm$^2$) | higher than 3,000 | higher than 3,000 |
| Permeability to gas (nPm) | 0 | 0 |
| Refractoriness under load (°C.) | higher than 1,740 | higher than 1,740 |
| Modulus of elasticity (kp/cm$^2$, static) | 438,300 | 388,000 |
| Cold bending strength (kp/cm$^2$) | 848 | 375 |
| Hot bending strength at 1500° C. (kp/cm$^2$) | 137 | 50 |
| Maximum thermal expansion at 1500° C. (%) | 0.89 | 1.2 |
| Creep test according to DIN 51053, permanent deformation after 24 hours at 1500° C. at a load of 2 kp/cm$^2$ (%) | 0.2 | 0.2 |
| Bending strength after 25 cycles, according to thermal shock test method for refractories of DIN 51068, sheet 2 (kp/cm$^2$) | 56 | 40 |

In designing the dimensions of the insert, the width b of the insert is important and is dimensioned in the following manner as a function of the predetermined diameter D of the throughflow opening 3, and further as a function of the important properties of bending strength, modulus of elasticity, and coefficient of thermal expansion of the insert. Specifically, the width b of the insert is dimensioned according to the following formula:

$$b \leqq D\left[1 + 10\left[\frac{\text{Cold Bending Strength}}{\text{Modulus of Elasticity} \times \text{Maximum Thermal Expansion at 1500° C. in absolute decimal units}}\right]\right]$$

In other words, when D equals 35 mm, then b in Example 1 above is less than or equal to 110 mm, and b in Example 2 above is less than or equal to 63.4 mm.

The actual width b of a given insert may be selected to be of a convenient dimension, within the bounds of the above formula, and within the range of from 1.3 to 3.5 times the diameter D. Thus, the selected width b for Example 1 above was 75 mm, and the selected width b for Example 2 above was 62 mm.

Molded and fired inserts 2 having the above width, and having a thickness of 15 mm and a length of 200 mm which corresponds to the predetermined length of sliding movement of the plate, were bored or drilled to produce throughflow openings 3, and then the upper gliding surfaces of the inserts were ground as desired to provide smooth sliding surfaces.

Basic plate elements 1, for each of Examples 1 and 2, were molded to have dimensions of approximately 200 mm width by 400 mm length, from the following refractory concrete mixtures:

| Material | % by weight Example 1 | Example 2 |
|---|---|---|
| $Al_2O_3$ | 94.5 | 97.1 |
| $SiO_2$ | 0.5 | 0.4 |
| $Fe_2O_3$ | 0.2 | 0.2 |
| $TiO_2$ | 0.1 | 0.1 |
| CaO | 4.2 | 1.8 |
| MgO | 0.1 | 0.1 |
| $Na_2O$ | 0.3 | 0.2 |
| $K_2O$ | 0.1 | 0.1 |
| | 100 | 100 |

Such mixtures of moldable refractory concrete were placed in suitable molds, and the respective already finished ceramic oxide inserts were embedded in the moldable refractory concrete material. After the concrete set, the composite refractory plates of each Example were treated at 600° C.

Several two-element composite refractory plates in accordance with each of the above Examples 1 to 2 were employed in slide closures, and after use for eight to ten liquid metal melt pouring operations, such refractory plates exhibited only slight wear and no cracks.

Figure 3:
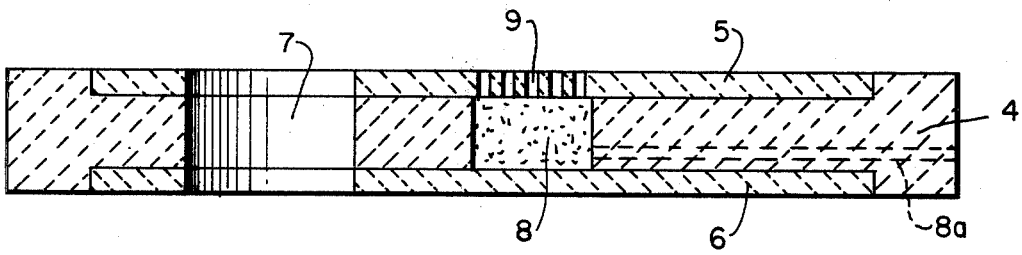
FIG. 3 is a longitudinal cross-section through a refractory plate in accordance with a further embodiment of the present invention.

With reference to FIG. 3 of the drawings, there is shown a further embodiment of the refractory plate of the present invention. Specifically, the refractory plate of this embodiment may be employed as the central plate in a three-plate arrangement, wherein the central plate slides against both an upper and a lower plate. In such arrangement, a basic plate element 4 may be formed of materials and in the manner described above. Opposite major surfaces of basic plate element 4 have embedded therein ceramic oxide inserts 5 and 6, made of materials and in a manner described above with regard to ceramic oxide insert 2.

FIG. 3 of the drawings also shows that the concept of the present invention may be modified to accommodate a refractory plate of the type wherein gas is supplied to that portion of the upper surface of the refractory plate which faces the pouring nozzle of the vessel when the slide closure is in the closed position, to thereby prevent freezing of the melt within the vessel spout. Specifically, a gas permeable element 8, of known construction and composition, may be embedded in basic plate element 4. A suitable gas may be supplied from a supply source through a duct or ducts, schematically represented at **8*a* in FIG. 3, which extend through the plate, such that the gas is supplied to element 8. From element 8 the gas may pass upwardly through bores 9 provided in insert 5, such that the gas would pass into the vessel spout when the slide plate is in its closed position, to thereby prevent freezing of the melt. It is to be understood that this feature of the present invention is not limited to use only with the embodiment of FIG. 3**, but rather may be employed in all potential embodiments of the present invention.

Figure 4:
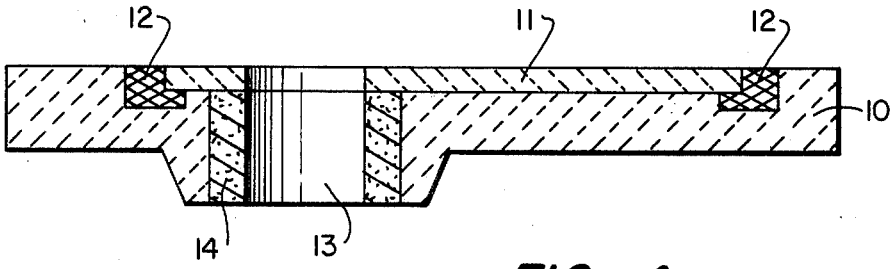
FIG. 4 is a longitudinal cross-section through a refractory plate in accordance with an even further embodiment of the present invention.

With reference now to FIG. 4 of the drawings, a still further feature of the present invention will be described. Specifically, it is possible during the drying or thermal heat treatment employed to produce the composite refractory plate of the present invention that there will be differential expansion or shrinkage between the insert and the basic plate element. It is further possible that any stresses resulting from such potential differential expansion and shrinkage could result in damage to the composite elements of the refractory plate. Accordingly, in accordance with this embodiment of the present invention, the composite refractory plate is modified to provide an elastic layer 12 to circumferentially surround the periphery of a ceramic oxide insert 11 and to separate such ceramic oxide periphery from basic plate element 10. Thus, during the production of the composite refractory plate, and specifically during any necessary drying or thermal treatment thereof, any differential expansion or shrinkage between the insert 11 and the basic plate element 10 will be absorbed or neutralized by elastic layer 12.

It is believed to be apparent to those skilled in the art that elastic layer 12 may be made of a great variety of materials, as long as the material involved operates to achieve the above resiliency or flexibility, and further as long as the elastic layer 12 will satisfactorily function as a portion of the refractory plate during normal use after production of the plate. In other words, elastic layer 12 must not only be flexible enough to neutralize any potential differential expansion or shrinkage during the production of the refractory plate, but thereafter, during the normal use of the refractory plate, the layer 12 must be of a material which will satisfactorily function as a portion of the composite refractory plate. The material of layer 12 may consist of an elastically flexible moldable refractory concrete material of the same type as used to form basic plate element 10, but made flexible to an extent required for compensation of the above discussed expansion or shrinkage. Such flexibility may be achieved by selecting a suitable grain size of the material employed, for example a grain size of up to 0.5 mm. Also, flexibility may be provided by adding to the moldable refractory concrete an elasticity producing means, for example approximately 3% by weight of a material such as Styrofoam or paper powder which will burn out during the baking or heat treatment of the composite plate. Further, the material of the layer could include a band of synthetic resin material having added thereto ceramic fillers. It is believed that one of ordinary skill in the art will be readily cognizant of the types of materials which could be used to form elastic layer 12 to achieve the above desired and set forth results. It is further to be understood that the elastic layer 12 shown in FIG. 4 could be used to surround one or both of the ceramic oxide inserts shown in the embodiment of FIG. 3.

FIG. 4 of the drawings also shows a further possible modification which may be employed in any of the embodiments of the present invention. Specifically, that portion of throughflow opening 13 which is formed in basic plate element 10 may be defined by an annular element 14 which is permeable to gas and which is fixedly positioned within a larger diameter opening in basic plate element 10.

Although preferred embodiments of the present invention have been specifically described and illustrated herein, it is to be understood that various modifications may be made to such specific structural arrangements without departing from the scope of the present invention.

What we claim is:

1. A refractory plate for use in slide closures for metallurgical vessels, said refractory plate comprising:

a basic plate element adapted to face a liquid metal melt, said basic plate element being formed of a moldable refractory concrete material;

said basic plate element having embedded therein and forming a melt contacting surface thereof a ceramic oxide insert having a cold bending strength higher than 300 kp/cm$^2$, a hot bending strength at 1500° C. higher than 40 kp/cm$^2$, a cold compressive strength higher than 2000 kp/cm$^2$, and a permeability to gas lower than 1.0 nanoperm;

said insert being enbedded directly in said moldable refractory concrete material of said basic plate element before said moldable refractory concrete material has set;

said basic plate element and said insert having extending therethrough a throughflow opening; and said insert having a width, taken in a direction transverse to the direction of movement of said refractory plate when used in a slide closure, of from 1.3 to 3.5 times the diameter of said throughflow opening.

2. A plate as claimed in claim 1, wherein said moldable refractory concrete material comprises 70 to 95% by weight of alumina, and 5 to 30% by weight of a cement containing approximately 80% by weight alumina.

3. A plate as claimed in claim 2, wherein said 70 to 95% by weight alumina comprises tabular alumina having a grain size of up to 6.0 mm.

4. A plate as claimed in claim 1, wherein said moldable refractory concrete material comprises 70 to 95% by weight of an alumina-containing raw material containing more that 70% by weight of alumina, and 5 to 30% by weight of a cement containing approximately 80% by weight alumina.

5. A plate as claimed in claim 4, wherein said raw material is at least one material selected from the group consisting of sintered bauxite, synthetic mullite, corundum, and grinding disk fragments.

6. A plate as claimed in claim 1, wherein said ceramic oxide insert is formed of a material having a melting point higher than 1950° C.

7. A plate as claimed in claim 1, wherein said ceramic oxide insert is formed of at least one material selected from the group consisting of MgO, $Cr_2O_3$, $Al_2O_3$ and $ZrO_2$.

8. A plate as claimed in claim 7, wherein said ceramic oxide insert is formed of a mixture of $Al_2O_3$ and $ZrO_2$.

9. A plate as claimed in claim 7, wherein said ceramic oxide insert is formed of a mixture of $ZrO_2$ and $Cr_2O_3$.

10. A plate as claimed in claim 1, wherein said ceramic oxide insert is formed of at least 99% by weight of at least one oxide material having a melting point higher than 1950° C.

11. A plate as claimed in claim 1, further comprising a layer of elastic material circumferentially surrounding the outer periphery of said insert and separating said insert outer periphery from said basic plate element.

12. A plate as claimed in claim 11, wherein said elastic material is formed of a moldable refractory concrete material having a grain size of up to 0.5 mm, and having added thereto approximately 3% by weight of paper powder.

13. A plate as claimed in claim 11, wherein said layer of elastic material comprises a band formed of a synthetic resin material having added thereto ceramic filler material.

14. A plate as claimed in claim 1, wherein said basic plate element has embedded in each of two opposite major surfaces thereof a said ceramic oxide insert.

15. A plate as claimed in claim 1, wherein said ceramic oxide insert has therein gas passages, and said basic plate element has therein a gas feed communicating with said gas passages.

* * * * *